US006703079B2

(12) United States Patent
Clifford et al.

(10) Patent No.: US 6,703,079 B2
(45) Date of Patent: Mar. 9, 2004

(54) METHOD FOR PAINTING WITH A BELL APPLICATOR

(75) Inventors: Scott J. Clifford, Rochester Hills, MI (US); Matthew R. Sikowski, Van Buren Township, MI (US)

(73) Assignee: Fanuc Robotics North America, Inc., Rochester Hills, MI (US)

( * ) Notice: Subject to any disclaimer, the term of this patent is extended or adjusted under 35 U.S.C. 154(b) by 0 days.

(21) Appl. No.: 10/154,287

(22) Filed: May 23, 2002

(65) Prior Publication Data

US 2002/0182323 A1 Dec. 5, 2002

Related U.S. Application Data

(60) Provisional application No. 60/293,045, filed on May 23, 2001.

(51) Int. Cl.[7] ..... B05D 1/02

(52) U.S. Cl. ..... 427/421; 427/475; 427/477; 427/480

(58) Field of Search ..... 427/475, 477, 427/479, 480, 484–486, 421, 424, 428, 429

(56) References Cited

U.S. PATENT DOCUMENTS 3,709,190 A 1/1973 Van Gottberg et al.
4,199,896 A 4/1980 Lehman
4,985,283 A * 1/1991 Ogata et al.
5,372,856 A * 12/1994 Ogasawara
5,814,375 A 9/1998 Hissen
5,989,643 A 11/1999 Nakagawa et al.

OTHER PUBLICATIONS

"Reader's Digest Complete Do–It Yourself Manual", The Reader's Digest Association, Inc, pp. 328–329, 1973.*

* cited by examiner

*Primary Examiner*—Fred J. Parker
(74) *Attorney, Agent, or Firm*—MacMillan, Sobanski & Todd, LLC

(57) ABSTRACT

A method for painting a panel using a paint applicator defines a painting pattern with a plurality of points on a surface of a panel to be painted, the pattern extending in a predetermined direction and the points defining opposite edges of the pattern extending in a predetermined direction, with at least one edge of the pattern being adjacent an edge of the panel. The applicator is moved relative to the panel to apply the paint in the painting pattern having a desired film thickness. The pattern including a first plurality of pattern segments and a second plurality of reinforcing segments, the pattern segments being connected together each extending between an associated pair of the points on the opposite edges of the pattern, and the reinforcing segments each extending between an associated pair of the points adjacent the edge of the panel. A plurality of different painting patterns can be stored in a memory for selecting the one pattern to be used.

17 Claims, 3 Drawing Sheets

METHOD FOR PAINTING WITH A BELL APPLICATOR

CROSS-REFERENCE TO RELATED APPLICATION

This application claims the benefit of the U.S. provisional patent application Ser. No. 60/293,045, filed May 23, 2001.

BACKGROUND OF THE INVENTION

The present invention relates generally to a method for painting panels and, in particular, to a method for painting the outer panels of an automobile body.

Typically, rotary type electrostatic spray painting devices, bell atomizers or applicators that generally apply round or elliptical patterns, are used to paint the outer panels of an automobile body as the body is moved along an assembly line. The desired result is a good painted surface of uniform required film thickness. However, the paint application distribution inherent in bell applicators and the shapes of the body panels present many problems to be overcome.

For example, the outer side panels of an automobile body include front and rear wheel openings or cutouts. Thus, portions of these side panels over the wheel openings have a shorter vertical length than other portions. In order to properly paint the shorter portions, one prior art solution is to locate bell applicators above and below a central horizontal plane of the side panels. In this configuration, a distance between the side panel and the spray head is always constant such that a good painted surface is obtained. Since, however, the side panels are divided into two or three portions for painting, four to six spray heads are necessary for one coating. As a result, the painting system requires a large space in which to locate the many spray heads, and the equipment costs are relatively high.

Another prior art electrostatic spray painting device has spray heads that move up and down along a vertical line to enable the outer side panels to be painted by one spray head, so that the number of spray heads needed by the painting device is drastically reduced. However, in this painting device, since the spray head moves away from the side panel during reciprocation of the spray head due to a configuration of the side panel, the electrostatic charge of the paint particles may be lost. In this case paint particles that have lost their electrostatic charge will adhere to the side panel and the quality of the painted surface is degraded.

Another prior art solution is to spray onto the side panels with spray heads moving along an outline of the panels. Such a configuration requires a programmed movable member that maintains the spray head a uniform distance from the side panel surface and aligns an axis of the spray head substantially perpendicular to the adjacent plane of the side panel.

Conventional painting methods use a standard "W" (FIG. 1) wave pattern which results in a trapezoidal film build profile (FIG. 2). This pattern is acceptable and desired when meeting additional "W" wave patterns at the edges. When painting the edge of a panel the spray pattern must be significantly extended past the edge of the panel to attain acceptable uniformity or a perpendicular stroke is required to add additional film build at the edges. The perpendicular reinforcement stroke is undesirable because it requires additional machine travel and wasted time moving to and from the start and end of the pattern.

SUMMARY OF THE INVENTION

The present invention concerns a method for painting a panel using a bell applicator comprising the steps of: providing a bell applicator; providing paint to the applicator; defining a painting pattern with a plurality of points on a surface of a panel to be painted, the pattern extending in a predetermined direction and the points defining opposite edges of the pattern extending in the predetermined direction, at least one edge of the pattern being adjacent an edge of the panel; and moving at least the applicator relative to a panel to apply the paint to the surface of the panel in the predetermined pattern having a desired film thickness, the pattern including a first plurality of pattern segments and a second plurality of reinforcing segments, the pattern segments being connected together each extending between an associated pair of the points on the opposite edges of the pattern, and the reinforcing segments each extending between an associated pair of the points at the at least one edge of the pattern adjacent the edge of the panel. The pattern can include: a "W" shaped triangular pattern formed by the pattern segments; a triangular pattern of substantially vertical ones of the pattern segments alternating with angled ones of the pattern segments; a crossing triangular pattern formed by crossed pairs of the pattern segments; or a square pattern having opposed sides formed by pairs of the pattern segments.

The reinforcing segments can include longer reinforcing segments extending in the predetermined direction and shorter reinforcing segments extending transverse to the predetermined direction connecting opposite ends of each of the longer reinforcing segment to the associated pair of points. The method also can include including a third plurality of reinforcing segments each extending in the predetermined direction between an associated pair of the points at another one of the edges of the pattern. A plurality of different painting patterns can be stored and one of the stored patterns selected for performing the method. The pattern segments and the reinforcing segments are applied to the surface of the panel as a continuous pattern including applying the paint continuously to the surface of the panel from a beginning to an end of the pattern.

The invention also concerns a system for painting a panel using a bell applicator including: a bell applicator; a source of paint connected to said bell applicator; and a control means connected to said bell applicator for moving at least said bell applicator relative to a panel to apply paint from said source to a surface of the panel in a predetermined pattern having a desired film thickness, said pattern extending in a predetermined direction and including a plurality of connected segments extending between spaced apart points defining opposite edges of said pattern extending in said predetermined direction, at least one of said segments being a reinforcing segment extending in said predetermined direction between a pair of said points at one of said edges of said pattern adjacent an edge of the panel. The pattern is a selected one of a plurality of painting patterns and the system includes a memory connected to said control means for storing said plurality of painting patterns. The system also includes an input device connected to said control means for selecting one of said plurality of painting patterns.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
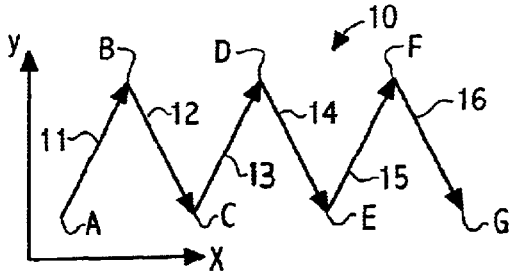
FIG. 1 (PRIOR ART)
FIG. 1 shows a standard "W" wave pattern for a painting method according to the prior art.

There is shown in FIG. 1 a prior art pattern 10 for painting utilizing a bell atomizer or applicator. Currently, the process of painting automobile body panels uses high shaping air to focus the bell pattern. The high shaping air pattern is defined as applications where greater than 200 slpm of shaping air is used to attain a smaller focused bell pattern typically having a fan width less than 15" wide. Fan width for the process is defined as the width of a paint profile at ½ of the film build of the highest 8" moving average. A focused fan pattern is used to improve part relative transfer efficiency or to increase particle velocity.

The body panel moves along an assembly line past a painting station at which is located a bell atomizer. While either the body panel, or the bell atomizer, or both are moved horizontally, the bell atomizer is operated to deposit a film of paint on the facing surface of the body panel utilizing a series of up and down motions resulting in a "W" pattern 10 as shown in FIG. 1. The prior art pattern and the patterns according to the present invention are described herein in terms of movement in a plane (horizontal and vertical coordinates) since it is desirable to maintain a constant distance between the bell atomizer and the surface being painted. Thus, the bell atomizer may also be moving along a third axis following a contour of the body panel.

Starting at a point A, the bell atomizer painting pattern moves upwardly and to the right to deposit a first pattern segment 11 terminating at a point B. The bell atomizer path then changes direction moving downwardly and to the right from the point B to deposit a second pattern segment 12 terminating at a point C. At the point C, the bell atomizer again changes direction moving upwardly parallel to the segment 11 to deposit a third pattern segment 13 terminating at a point D. Similar movements result in a fourth pattern segment 14 between the point D and a point E, a fifth pattern segment 15 between the point E and a point F, a sixth pattern segment 16 between the point F and a point G, and so on until the panel is completely painted. The segments 11 through 16 typically extend at an angle greater than 45° with respect to horizontal.

Figure 2:
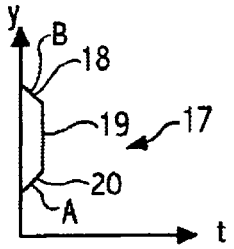
FIG. 2 (PRIOR ART)
FIG. 2 is a plot of a paint film build profile produced by the pattern shown in FIG. 1.

When the standard "W" wave pattern 10 is used the resulting film forms a trapezoidal film build profile (see FIG. 2. This pattern is acceptable and desired when meeting additional "W" wave patterns at the edges of the pattern 10. However, when painting the edge of a panel the spray pattern must be significantly extended past the edge of the panel to attain acceptable uniformity or a perpendicular stroke is required to add additional film build at the edges. This reinforcement stroke is undesirable because it requires additional machine travel and wasted time moving to and from the start and end of the pattern 10.

FIG. 2 is a plot of a trapezoidal paint film build profile 17 produced by the pattern 10 shown in FIG. 1. The profile 17 represents film thickness "t" along the horizontal axis verses distance or position on the pattern 10 along the vertical or "Y" axis. The thickness increases from no coverage to a maximum amount over a first profile portion 18 representing an area at the edge of the pattern 10 that is not crossed by the full diameter of the fan. A second desired thickness profile portion 19 covers most of the pattern 10 and a third decreasing thickness profile portion 20 is at the opposite edge of the pattern. Although the fan overlaps along most of the pattern 10 as successive segments are traversed, there is no overlap at the edges of the pattern such that the film thickness varies is as shown in the portions 18 and 20.

The improved painting method according to the present invention provides more uniform film builds near the edges of the panels. There are several embodiments where reinforcement strokes can be built into a reciprocating bell application pattern such as:

1. A dual edge reinforced triangular approach can be used to provide additional film build for surfaces painted by one machine where the surface has two edges. See the following description of the FIGS. 3, 5, 6, 11, 12, 14 and 16.
2. A single edge reinforced triangular approach can be used to provide additional film build for surfaces painted by one machine where the surface has a single edge. See the following description of the FIGS. 7, 8, 13 and 15.
3. A dual edge reinforced square wave approach can be used to provide additional film build for surfaces painted by one machine where the surface has two edges. See the following description of the FIGS. 9 and 10. This works best for applications where two coats are applied with a 50/50 film build split. The second coat is inverted and applied directly atop the first coat.

The painting method according to the present invention overcomes the shortcomings of the conventional "W" wave pattern 10 by the use of a focused fan pattern high shaping air bell that allows a pattern of bell movement that gives improved film build at the edges without wasted movement time. In these movement patterns the reinforcement stroke is built into the pattern rather than being added afterward.

Weave patterns for bell painting have long been used by reciprocating bell machines. Since these machines are restricted in their travel, "W" patterns and square patterns delivering reduced film build or over-spray at the edges has been the norm. Using a robot with significant path capability and a focused pattern bell allows the generation of novel patterns for applying the paint that has improved characteristics. The patterns described below can be executed by a robot and deliver significant reinforcement and additional film build at the edges of the part with minimized over-spray. The patterns are accomplished by making the segment movements shown in the following figures proceeding from point to point in alphabetical order.

A first embodiment painting pattern 30 according to the present invention incorporates the segments 11 through 16 of the "W" pattern 10 shown in FIG. 1. However, a dual edge reinforced triangular approach is used to provide additional film build for surfaces painted by one machine where the surface has two edges. A lower edge pattern reinforcing segment 31 is applied between the points A and G passing through the points C and E. An upper edge pattern reinforcing segment 32 is applied between the points B and F passing through the point D.

Figure 3:
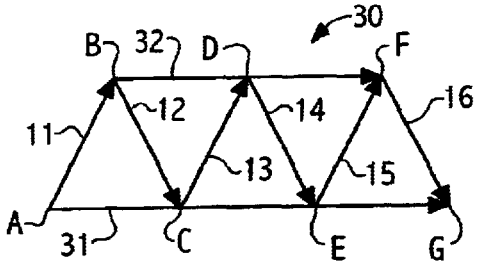
FIG. 3 shows an edge reinforced pattern for a first embodiment painting method according to the present invention.
Figure 4:
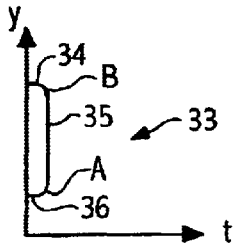
FIG. 4 is a plot of a paint film build profile produced by the pattern shown in FIG. 3.

FIG. 4 is a plot of a paint film build profile 33 produced by the pattern 30 shown in FIG. 3. The profile 33 is similar to the profile 17 of FIG. 2 in that the film thickness "t" is along the horizontal axis verses distance or position on the pattern 33 along the vertical or "Y" axis. The thickness increases from no coverage to a maximum amount over a first profile portion 34 representing an area at the edge of the pattern 30 that is not crossed by the fill diameter of the fan. A second desired thickness profile portion 35 covers most of the pattern 10 and a third decreasing thickness profile portion 36 is at the opposite edge of the pattern. The reinforcing segments 31 and 32 increase the film thickness in the edge areas represented by the profile portions 34 and 36 as compared with the profile portions 18 and 20.

Figure 5:
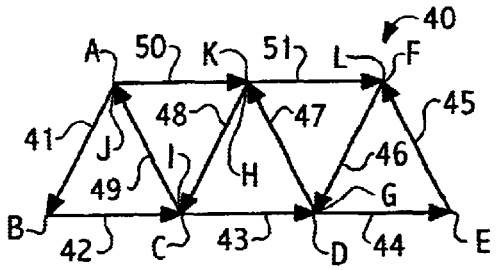
FIGS. 5 through 15 show additional embodiments of the edge reinforced pattern painting method according to the present invention.

As shown in FIG. 5, a second embodiment painting pattern 40 according to the present invention is similar to the pattern 30 shown in FIG. 3 but does not require stopping and starting the paint application to separately apply the reinforcing segments 31 and 32. A plurality of pattern segments 41 through 51 is applied connecting the points A through L without stopping the bell applicator. The segments 42 through 44, 50 and 51 are the lower and upper reinforcing segments.

Figure 6:
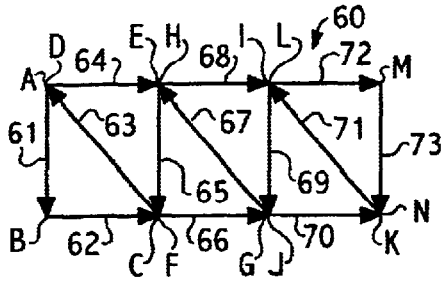

As shown in FIG. 6, a third embodiment painting pattern 60 according to the present invention is similar to the pattern 40 shown in FIG. 5 but alternate vertical segments are perpendicular to the reinforcing segments. A plurality of pattern segments 61 through 73 is applied connecting the points A through N without stopping the bell applicator. The segments 62, 64, 66, 68, 70 and 72 are the lower and upper reinforcing segments and the alternate vertical segments 61, 65, 69 and 73 extend perpendicular to the reinforcing segments.

Figure 7:
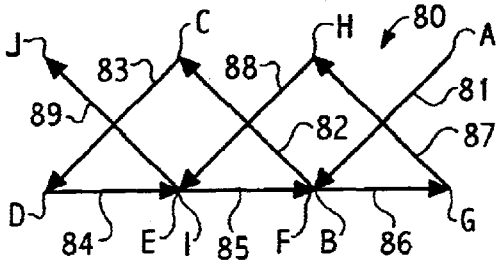

As shown in FIG. 7, a fourth embodiment painting pattern 80 according to the present invention is a crossing triangular pattern that does not require stopping and starting the paint application where reinforcing segments are required along only one edge. A plurality of pattern segments 81 through 89 is applied connecting the points A through J without stopping the bell applicator. The segments 84 through 86 are the lower reinforcing segments. This pattern could be inverted to produce upper reinforcing segments.

Figure 8:
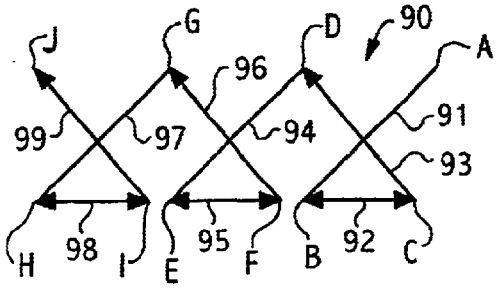

As shown in FIG. 8, a fifth embodiment painting pattern 90 according to the present invention is a crossing triangular pattern similar to the pattern 80 of FIG. 7 that does not require stopping and starting the paint application where reinforcing segments are required along only one edge. A plurality of pattern segments 91 through 99 is applied connecting the points A through J without stopping the bell applicator. The segments 92, 95 and 98 are the lower reinforcing segments. This pattern could be inverted to produce upper reinforcing segments. Depending upon the spraying process settings, there can be a problem with too much film thickness at the junctions of the reinforcing segments, such as at the coincident points B and F in FIG. 7. The pattern 90 eliminates this problem by slightly offsetting the ends of the reinforcing segments as shown by the gap between the points B and F in FIG. 8.

Figure 9:
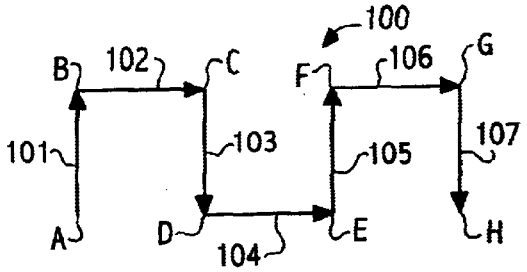
Figure 10:
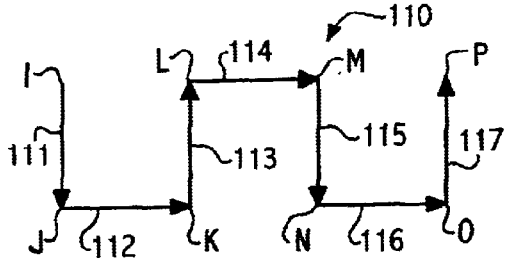

As shown in FIGS. 9 and 10, a sixth embodiment painting pattern 100 and 110 according to the present invention wherein a dual edge reinforced square wave approach can be used to provide additional film build for surfaces painted by one machine where the surface has two edges. The two coats 100 and 110 are applied with a 50/50 film build split with the second coat 110 inverted and applied directly atop the first coat 100. A plurality of pattern segments 101 through 107 is applied connecting the points A through H without stopping the bell applicator. The segments 102, 104 and 106 are the reinforcing segments. A plurality of pattern segments 111 through 117 are applied connecting the points I through P without stopping the bell applicator. The segments 112, 114 and 116 are the reinforcing segments. The second coat 110 begins at the point I, which corresponds to the point A in the first coat 100, and ends at the point P, which corresponds to the point G in the first coat.

Figure 11:
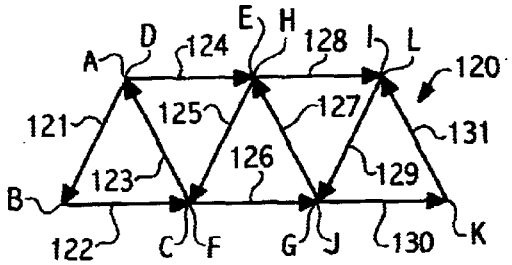

As shown in FIG. 11, a seventh embodiment painting pattern 120 according to the present invention is a triangular pattern similar to the pattern 40 of FIG. 5 that does not require stopping and starting the paint application. A plurality of pattern segments 121 through 131 is applied connecting the points A through L without stopping the bell applicator. The segments 122, 124, 126, 128 and 130 are the reinforcing segments.

Figure 12:
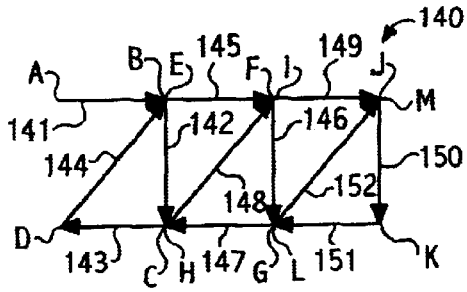

As shown in FIG. 12, an eighth embodiment painting pattern 140 according to the present invention is a triangular pattern similar to the pattern 60 of FIG. 6 that does not require stopping and starting the paint application. A plurality of pattern segments 141 through 152 is applied connecting the points A through M without stopping the bell applicator. The segments 141, 143, 145, 147, 149 and 151 are the reinforcing segments.

Figure 13:
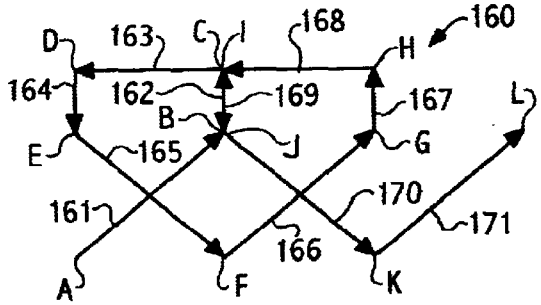

As shown in FIG. 13, a ninth embodiment painting pattern 160 according to the present invention is a crossing triangular pattern similar to the pattern 80 of FIG. 7 that does not require stopping and starting the paint application where reinforcing segments are required along only one edge. A plurality of pattern segments 161 through 171 is applied connecting the points A through L without stopping the bell applicator. The short vertical segments 162, 164, 167 and 169 and the longer horizontal segments 163 and 168 are the upper reinforcing segments. This pattern could be inverted to produce lower reinforcing segments. Except for the ends of the pattern, the short vertical segments will be doubled such as the segments 162 and 169.

Figure 14:
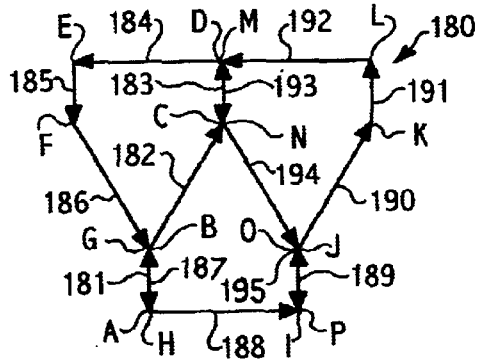

As shown in FIG. 14, a tenth embodiment painting pattern 180 according to the present invention is a "W" pattern that does not require stopping and starting the paint application where reinforcing segments are required along both edges. A plurality of pattern segments 181 through 195 is applied connecting the points A through P without stopping the bell applicator. The short vertical segments 181, 183, 185, 187, 189, 191, 193 and 195 and the longer horizontal segments 184, 188 and 192 are the reinforcing segments. Except for the ends of the pattern, the short vertical segments will be doubled such as the segments 181 and 187.

Figure 15:
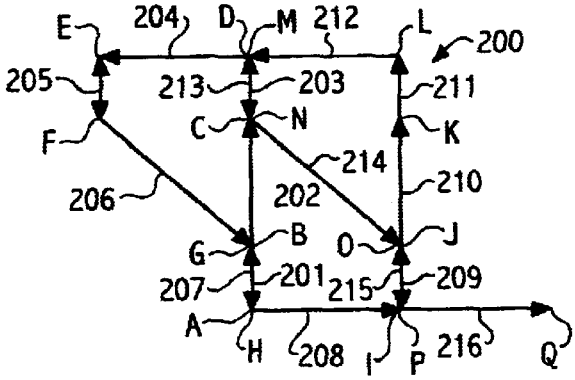

As shown in FIG. 15, an eleventh embodiment painting pattern 200 according to the present invention is a triangular pattern similar to the pattern 140 of FIG. 12 that does not require stopping and starting the paint application and where reinforcing segments are required along both edges. A plurality of pattern segments 201 through 216 is applied connecting the points A through Q without stopping the bell applicator. The short vertical segments 201, 203, 205, 207, 209, 211, 213 and 215 and the longer horizontal segments 204, 208 and 212 are the reinforcing segments. Except for the ends of the pattern, the short vertical segments will be doubled such as the segments 201 and 207.

Figure 16:
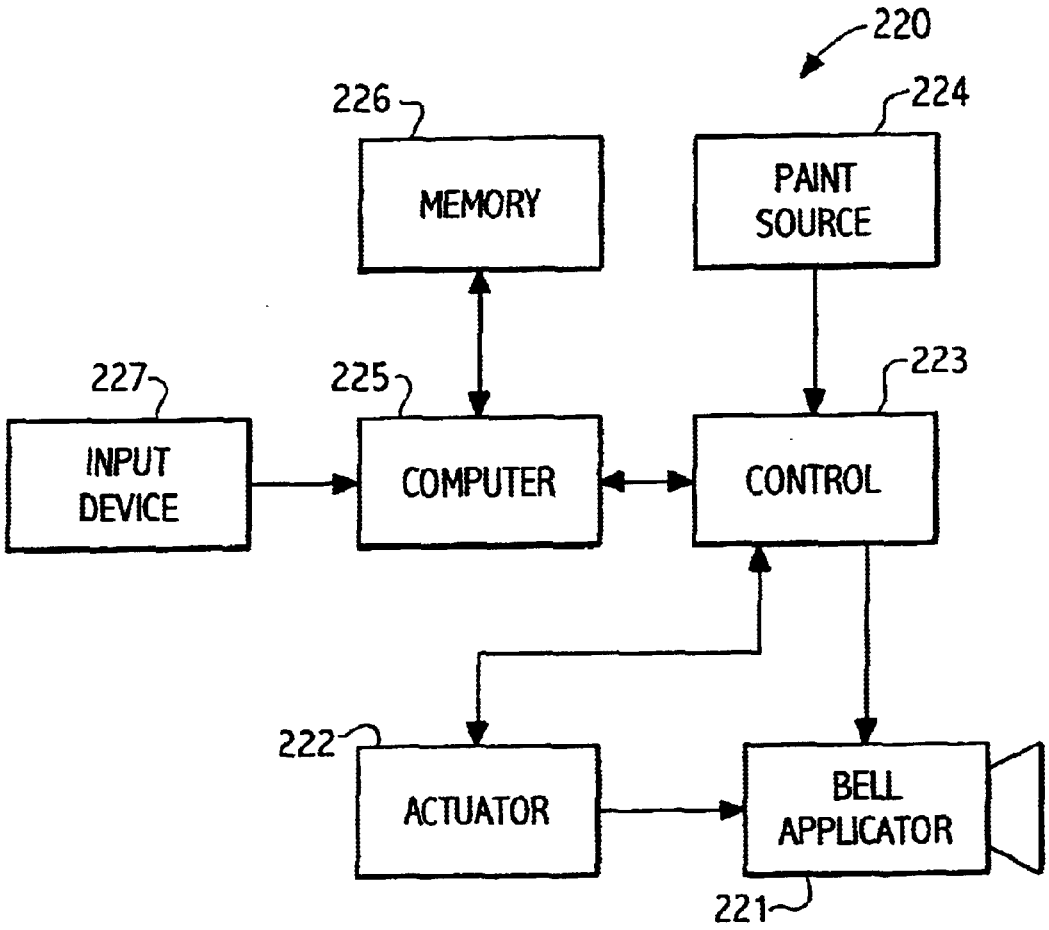
FIG. 16 is a schematic block diagram of a system for performing the painting method according to the present invention.

There is shown in FIG. 16 a system 220 for performing the method of painting according to the present invention. A bell applicator 221 is moved according to the desired painting pattern by an actuator 222 such as a robot. The actuator 222 is responsive to a control 223 that provides positioning signals. A paint source 224 is connected to the bell applicator 221 through the control 223 to selectively provide paint when required. The control 223 is connected to and responsive to signals generated by a computer 225.

Computer programs for defining the patterns 30, 40, 60, 80, 90, 100, 110, 120, 140, 160, 180 and 200 are stored in a memory 226 connected to the computer 225. An input device 227 also is connected to the computer 225 for storing the programs in the memory 226, changing the programs as required, selecting the program corresponding to the pattern to be painted and causing the computer 225 to operate the control 223.

Although the method and apparatus according to the present invention have been shown and described in terms of a bell applicator spraying liquid paint, any type of spray applicator can be used. For, example, the applicator 221 shown in FIG. 16 could be a powder spray applicator of either the bell or gun type. Thus, the method and apparatus according to the present invention generally concern applying paint in a pattern with a paint applicator.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for painting a panel using a paint spray applicator comprising the steps of:

a) providing a paint spray applicator;

b) providing paint to the paint spray applicator;

c) moving at least the paint spray applicator relative to a surface of a panel to be painted in a predetermined pattern, the pattern extending in a predetermined direction generally parallel to an edge of the panel and being formed of a plurality of connected pattern segments including segments extending generally transverse to the predetermined direction and between spaced apart points defining generally parallel opposite edges of the pattern, the pattern segments further including at least one reinforcing segment extending generally in the predetermined direction between a pair of the points at a one of the edges of the pattern adjacent the edge of the panel;

d) operating the paint spray applicator to apply the paint to the surface of the panel during said step c) whereby the paint applied along the transverse segments and the at least reinforcing segment coats the surface with a desired film thickness.

2. The method according to claim 1 wherein the pattern includes a "W" shaped triangular pattern formed of the transverse segments and the at least one reinforcing segment is connected to a pair of the transverse segments forming the "W" shaped triangular pattern.

3. The method according to claim 1 wherein the pattern includes a triangular pattern formed of substantially vertical ones of the transverse segments alternating with angled ones of the transverse segments and the at least one reinforcing segment is connected between one of the vertical transverse segments and one of the angled transverse segments.

4. The method according to claim 1 wherein the pattern includes a crossing triangular pattern formed of the transverse segments and the reinforcing segment is connected to a crossed pair of the transverse segments.

5. The method according to claim 1 wherein the pattern including a square pattern formed of the transverse segments and the reinforcing segment is connected to a pair of adjacent ones of the transverse segments.

6. The method according to claim 1 wherein the reinforcing segment is a longer reinforcing segment and including a pair of shorter reinforcing segments extending transverse to the predetermined direction connecting opposite ends of the longer reinforcing segment to the pair of points.

7. The method according to claim 1 including at least another reinforcing segment extending in the predetermined direction between another pair of the points at another one of the edges of the pattern adjacent another edge of the panel.

8. A method for painting a panel using a paint spray applicator comprising the step of:

a) providing a paint spray applicator;

b) providing paint to the paint spray applicator;

c) defining a painting pattern with a plurality of points on a surface of a panel to be painted, the pattern extending in a predetermined direction and the points defining generally parallel edges of the pattern extending in the predetermined direction, at least one of the edges of the pattern being adjacent an edge of the panel; and d) moving at least the paint spray applicator relative to the panel while applying the paint to the surface of the panel in the predetermined pattern to obtain a desired film thickness of the paint on the surface, the pattern including a first plurality of transverse pattern segments and a second plurality of reinforcing pattern segments, the transverse pattern segments being connected together with each extending between an associated pair of the points on the opposite edges of the pattern, and the reinforcing segments each extending between an associated pair of the points at the at least one edge of the pattern adjacent the edge of the panel.

9. The method according to claim 8 wherein the pattern includes a "W" shaped triangular pattern formed by the transverse pattern segments.

10. The method according to claim 8 wherein the pattern includes a triangular pattern of substantially vertical ones of the transverse pattern segments alternating with angled ones of the transverse pattern segments.

11. The method according to claim 8 wherein the pattern includes a crossing triangular pattern formed by crossed pairs of the transverse pattern segments.

12. The method according to claim 8 wherein the pattern includes a square pattern having opposed sides formed by pairs of the transverse pattern segments.

13. The method according to claim 8 wherein the reinforcing pattern segments include longer reinforcing segments extending in the predetermined direction and shorter reinforcing segments extending transverse to the predetermined direction connecting opposite ends of each of the longer reinforcing segments to the associated pair of points.

14. The method according to claim 8 including a third plurality of reinforcing pattern segments each extending in the predetermined direction between an associated pair of the points at another one of the edges of the pattern.

15. The method according to claim 8 including storing a plurality of different painting patterns each including transverse pattern segments and reinforcing pattern segments and selecting a stored one of the different painting patterns in said step c) for performing said step d).

16. The method according to claim 8 including performing said step d) by applying the paint along the transverse pattern segments and the reinforcing pattern segments on the surface of the panel as continuous pattern.

17. The method according to claim 8 including performing said step d) by applying the paint continuously to the surface of the panel from a beginning to an end of the pattern.

* * * * *